US010864401B2

(12) United States Patent
Schween

(10) Patent No.: US 10,864,401 B2
(45) Date of Patent: Dec. 15, 2020

(54) LOAD-ADJUSTING DEVICE AND LOCKING DEVICE

(71) Applicant: Kraftig Industries Pty Ltd, Sinnamon Park (AU)

(72) Inventor: Michael Schween, Sinnamon Park (AU)

( * ) Notice: Subject to any disclaimer, the term of this patent is extended or adjusted under 35 U.S.C. 154(b) by 0 days.

(21) Appl. No.: 15/739,505

(22) PCT Filed: Jun. 23, 2016

(86) PCT No.: PCT/AU2016/050534
§ 371 (c)(1),
(2) Date: Dec. 22, 2017

(87) PCT Pub. No.: WO2016/205885
PCT Pub. Date: Dec. 29, 2016

(65) Prior Publication Data

US 2018/0185694 A1 Jul. 5, 2018

(30) Foreign Application Priority Data

Jun. 23, 2015 (AU) ..... 2015902424
Oct. 19, 2015 (AU) ..... 2015904285
Oct. 19, 2015 (AU) ..... 2015904286

(51) Int. Cl.
*A63B 21/062* (2006.01)
*A63B 1/00* (2006.01)
(Continued)

(52) U.S. Cl.
CPC ..... *A63B 21/0626* (2015.10); *A63B 1/00* (2013.01); *A63B 21/0056* (2013.01);
(Continued)

(58) Field of Classification Search
CPC ..... A63B 21/078; A63B 21/0783; A63B 21/062–0632; A63B 21/072–08; A61H 3/008
See application file for complete search history.

(56) References Cited

U.S. PATENT DOCUMENTS 399,632 A 3/1889 Reach
2,666,640 A 1/1954 Jennings, Sr.
(Continued)

OTHER PUBLICATIONS

Australian Patent Office, International Search Report, PCT/AU2016/050534, dated Jun. 23, 2016.

*Primary Examiner* — Nyca T Nguyen
(74) *Attorney, Agent, or Firm* — Hamilton, Brook, Smith & Reynolds, P.C.

(57) ABSTRACT

A load-adjusting device for adjusting a load movably mounted to a frame of an exercise apparatus is provided. The device comprises a counterbalance; and a controller, wherein the counterbalance is configured to connect with the load in response to operation of the controller. Operation of the controller may configure the load-adjusting device between an unassisted configuration wherein the counterbalance is not in operative connection with the load, and an assisted configuration wherein the counterbalance is operatively connected with the load. A locking device for selectively constraining a movable component of an exercise apparatus is also provided. The locking device is suitable for use with the load-adjusting device.

17 Claims, 12 Drawing Sheets

(51) Int. Cl.

| | |
|---|---|
| ***A63B 21/00*** | (2006.01) |
| ***A63B 23/12*** | (2006.01) |
| ***A63B 21/078*** | (2006.01) |
| ***A63B 21/005*** | (2006.01) |
| ***A63B 21/072*** | (2006.01) |
| ***A63B 71/00*** | (2006.01) |
| *A63B 23/04* | (2006.01) |
| *A63B 22/20* | (2006.01) |

(52) U.S. Cl.

CPC ..... *A63B 21/0628* (2015.10); *A63B 21/078* (2013.01); *A63B 21/0724* (2013.01); *A63B 21/0783* (2015.10); *A63B 21/151* (2013.01); *A63B 21/154* (2013.01); *A63B 21/4035* (2015.10); *A63B 21/4049* (2015.10); *A63B 23/1209* (2013.01); *A63B 23/1218* (2013.01); *A63B 71/0054* (2013.01); *A63B 22/203* (2013.01); *A63B 2023/0411* (2013.01); *A63B 2071/0081* (2013.01); *A63B 2209/08* (2013.01); *A63B 2220/53* (2013.01); *A63B 2220/801* (2013.01)

(56) References Cited

U.S. PATENT DOCUMENTS 4,249,726 A * 2/1981 Faust ..... A63B 21/00181 482/104
4,253,662 A * 3/1981 Podolak ..... A63B 21/00181 482/104
4,349,192 A 9/1982 Lambert, Jr. et al.
4,561,651 A * 12/1985 Hole ..... A63B 21/06 482/102
4,567,990 A * 2/1986 Bellio ..... B66C 23/04 212/196
4,765,611 A * 8/1988 MacMillan ..... A63B 21/00072 482/112
4,795,149 A 1/1989 Pearson
4,836,535 A 6/1989 Pearson
4,846,458 A * 7/1989 Potts ..... A63B 21/00181 482/26
4,973,050 A * 11/1990 Santoro ..... A63B 21/00181 482/102
5,050,868 A 9/1991 Pearson
5,058,888 A * 10/1991 Walker ..... A63B 23/00 482/112
5,135,453 A 8/1992 Sollenberger
5,215,510 A 1/1993 Baran
5,314,394 A 5/1994 Ronan
5,322,489 A * 6/1994 Webb ..... A63B 21/00181 482/100
5,372,556 A * 12/1994 Ropp ..... A63B 21/0615 482/133
5,407,403 A * 4/1995 Coleman ..... A63B 21/00181 482/104
5,476,428 A * 12/1995 Potash ..... A63B 21/0058 482/5
5,554,084 A * 9/1996 Jones ..... A63B 21/0615 482/134
5,653,666 A * 8/1997 Pantoleon ..... A63B 21/078 482/108
5,669,859 A 9/1997 Liggett et al.
5,704,881 A * 1/1998 Dudley ..... A63B 69/0064 482/43
5,716,306 A 2/1998 Gallay
5,823,921 A * 10/1998 Dawson ..... A63B 21/00181 482/104
5,924,965 A * 7/1999 Vardy ..... A63B 21/0083 128/898
5,989,158 A 11/1999 Fredette
5,989,166 A * 11/1999 Capizzo ..... A63B 21/0783 482/1
6,117,049 A * 9/2000 Lowe ..... A63B 21/0628 482/4
6,224,519 B1 * 5/2001 Doolittle ..... A63B 21/152 482/5
6,293,892 B1 * 9/2001 Slawinski ..... A63B 21/00181 482/104
6,379,287 B1 * 4/2002 Slawinski ..... A63B 21/00181 482/104
6,537,182 B2 * 3/2003 Slawinski ..... A63B 21/00181 482/104
6,669,607 B2 * 12/2003 Slawinski ..... A63B 21/00181 482/104
6,702,724 B2 * 3/2004 Taylor ..... A63B 23/0405 482/101
6,926,649 B2 * 8/2005 Slawinski ..... A63B 21/00181 482/104
7,094,185 B2 * 8/2006 Greenland ..... A63B 21/06 482/100
7,163,488 B2 * 1/2007 Anders ..... A63B 21/0724 482/104
7,503,881 B2 * 3/2009 Quick ..... A63B 21/0609 482/102
7,717,837 B2 5/2010 Florczak
7,819,785 B2 * 10/2010 Maiaro ..... A63B 21/078 482/104
7,850,580 B2 * 12/2010 Johnson ..... A63B 21/0552 482/121
7,963,886 B1 * 6/2011 Schwinn ..... A63B 21/078 482/5
8,047,972 B1 11/2011 Dean et al.
8,328,698 B1 12/2012 Webber et al.
8,444,537 B1 * 5/2013 Santoro ..... A63B 21/078 482/104
8,517,900 B1 * 8/2013 Britt ..... A63B 21/0724 482/104
8,727,946 B2 * 5/2014 Greenhill ..... A63B 21/0058 482/5
8,784,281 B2 * 7/2014 Johnson, III ..... A63B 21/0783 482/104
8,900,097 B1 * 12/2014 Griggs ..... A63B 21/4029 482/4
8,900,099 B1 * 12/2014 Boyette ..... A63B 24/0075 482/5
8,968,155 B2 * 3/2015 Bird ..... A63B 21/0058 482/5
9,011,301 B2 * 4/2015 Balandis ..... A63B 24/0087 482/115
D735,821 S * 8/2015 Alenaddaf ..... A63B 21/0615 D21/686
9,174,086 B1 * 11/2015 Griggs ..... A63B 21/4029
9,327,160 B2 * 5/2016 Tauriainen ..... A63B 21/078
10,065,060 B2 * 9/2018 Simmons ..... A63B 21/0087
2002/0049123 A1 4/2002 Krull
2004/0176224 A1 * 9/2004 Slawinski ..... A63B 21/078 482/93
2004/0192519 A1 * 9/2004 Slawinski ..... A63B 21/00181 482/99
2005/0277524 A1 * 12/2005 Bae ..... A63B 21/00181 482/93
2006/0194678 A1 * 8/2006 Turner ..... A63B 21/078 482/94
2012/0244999 A1 * 9/2012 Tauriainen ..... A63B 21/078 482/104
2013/0137553 A1 * 5/2013 Kim ..... A61H 1/024 482/69
2013/0190143 A1 * 7/2013 Greenhill ..... A63B 21/0058 482/104
2014/0256516 A1 * 9/2014 Calderone ..... A61B 5/103 482/98
2014/0378279 A1 * 12/2014 Park ..... A63B 22/02 482/54

* cited by examiner

LOAD-ADJUSTING DEVICE AND LOCKING DEVICE

FIELD OF THE INVENTION

The present invention relates to a device suitable for adjusting a load of an exercise apparatus. More particularly, the invention relates, but is not limited, to a device for adjusting the force required to move a load comprising a component of an exercise apparatus. The invention also relates to a locking device suitable for use with movable components of an exercise apparatus. Load-adjusting devices of the invention may comprise one or more locking devices of the invention.

BACKGROUND OF THE INVENTION

Many exercises involve a user moving a load of an exercise apparatus. Generally, the load includes a movable component of the exercise apparatus. Often, the load can be increased, for example by adding weight to the component of the exercise apparatus.

In some cases movement of the component of an exercise apparatus itself requires substantial force. This may make the use of the exercise apparatus unsuitable for certain users, for example elderly users or those recovering from injury, who may have limited ability to exert force on the component.

Furthermore, when a user performs continuous (or rapidly repeated) exercises, sometimes referred to as sets, the user's muscles tire. Thus, the ability of the user to exert force on a component of an exercise apparatus decreases over the course of a set.

When available, an assistant or spotter can assist with lifting a load comprising a component of an exercise apparatus. However, in many circumstances, it would be desirable to be able to reduce the load without the need for an assistant or spotter.

It would also be particularly beneficial for a user to be able to reduce a load comprising a component of an exercise apparatus during use. For example, this would allow a user to perform sets with the component requiring a relative large amount of force, then reduce the force required to move the component when the user's muscles tired.

Another potential problem associated with the use of exercise equipment is uncontrolled movement of movable components. Such uncontrolled movement may result in damage to the exercise apparatus itself or surrounding property, and/or injury to a user or nearby person. These problems can be particularly severe for exercise apparatus that are used for lifting relatively heavy weights, for example those used for exercises such as bench presses, squats, and leg presses.

Some existing exercise apparatus comprise locking devices that prevent movement of movable components in all directions. However, in some cases it is desirable for the movement of components of an exercise apparatus to be constrained or prevented in a certain direction (or directions), but substantially unconstrained from movement in another direction (or directions).

Furthermore, many existing apparatus comprise locking devices that are difficult or impossible for a user to engage during use of the exercise apparatus.

OBJECT OF THE INVENTION

It is an aim of this invention to overcome or ameliorate one or more of the disadvantages or problems described above, or to at least provide a useful alternative.

Other preferred objects of the present invention will become apparent from the following description.

SUMMARY OF INVENTION

In a first form, although it need not be the only or indeed the broadest form, there is provided a load-adjusting device for adjusting a load movably mounted to a frame of an exercise apparatus, the device comprising:

a counterbalance; and a controller, wherein the counterbalance is configured to connect with the load in response to operation of the controller.

Preferably, operation of the controller can configure the load-adjusting device between an unassisted configuration wherein the counterbalance is not in operative connection with the load, and an assisted configuration wherein the counterbalance is operatively connected with the load.

Preferably, in the assisted configuration the load is reduced by the load-adjusting device. Preferably, in the unassisted configuration the load is substantially unaffected by the load-adjusting device.

Preferably, the load-adjusting device further comprises a pulley. Preferably, when the load and the counterbalance are operatively connected, the counterbalance applies a force to the load via the pulley.

Preferably, the counterbalance and the load are releasably connectable via a connecting member of the pulley. Preferably, operative connection of the load with the counterbalance requires connection of the counterbalance with the load via the connecting member of the pulley.

In one preferred form the connecting member of the pulley is releasably engageable with the load, and rigidly engaged with the counterbalance. In this preferred form, preferably, operation of the controller to disconnect the counterbalance from the holding member involves connection of the load with the pulley.

Alternatively, the connecting member of the pulley may be releasably engageable with the counterbalance, and rigidly engaged with the load. The connecting member may also be releasably engageable with the load and the counterbalance.

Preferably, the load-adjusting device comprises one or more locking devices for constraining movement of the load and/or the counterbalance relative to the frame of the exercise apparatus.

Preferably, the load-adjusting device comprises a locking device connected to the counterbalance.

Preferably, the load-adjusting device comprises a locking device connected to the load.

Preferably, operative connection of the load and the counterbalance requires unlocking of a locking device connected to the counterbalance.

Preferably the locking devices are locking devices for selectively constraining a movable component of an exercise apparatus, as hereinbelow described.

Additionally or alternatively, the load-adjusting device may further comprise a holding member connectable to the counterbalance.

Preferably, the holding member comprises: one or more mounting portions; and one or more connecting portions.

Preferably, the holding member is mounted to the frame of the exercise apparatus in a position above the counterbalance of the load-adjusting device.

Preferably the holding member is connectable to the counterbalance via an electromagnet. Preferably, the connecting portion of the holding member comprises the electromagnet.

Additionally or alternatively, the holding member may be mechanically engageable with the counterbalance. By way of example, in this alternative embodiment the counterbalance may engage with connecting portion of the holding member via a latch mechanism or male-female connection.

Preferably the counterbalance is substantially stationary relative to the frame of the exercise apparatus when connected to the holding member.

Preferably the counterbalance is movable relative to the frame of the exercise apparatus when disconnected from the holding member.

In embodiments wherein the load-adjusting device comprises a holding member, preferably, operative connection of the load and the counterbalance requires disconnection of the counterbalance from the holding member.

Preferably the counterbalance comprises: a counterbalance mounting portion; and a counterbalance receiving portion.

Preferably, the counterbalance mounting portion is movably mounted to the frame of the exercise apparatus. Preferably, the counterbalance mounting portion is rigidly engaged with a connection member of a pulley of the load-adjusting device.

Preferably, the receiving portion of the counterbalance facilitates adjustment of the force exerted by the counterbalance on the load. In one preferred embodiment the receiving portion is capable of receiving one or more weights.

In embodiments wherein the load-adjusting device comprises a holding member, the counterbalance may further comprise a counterbalance connecting portion for connection with the holding member.

Preferably the counterbalance connecting portion is connectable with a holding member comprising an electromagnet.

Alternatively or additionally, the counterbalance connecting portion itself may comprise an electromagnet. Alternatively or additionally, the counterbalance connecting portion may be mechanically connectable to the holding member.

In preferred embodiments, operation of the controller of the load-adjusting device signals one or more locking devices of the load-adjusting device, to configure the locking devices between a locked configuration and an unlocked configuration.

Preferably the controller signals the one or more locking devices electrically over wires. Alternatively or additionally, the controller may signal the one or more locking devices wirelessly. Alternatively or additionally, the controller may signal the holding one or more locking devices mechanically.

In an embodiment wherein the load-adjusting device comprises a holding member, preferably operation of the controller signals the holding member and/or the counterbalance of the load-adjusting device.

Preferably, signalling from the controller can disconnect the counterbalance from the holding member.

Preferably the controller signals the holding member and/or the counterbalance electrically over wires. Alternatively or additionally, the controller may signal the holding member and/or the counterbalance wirelessly. Alternatively or additionally, the controller may signal the holding member mechanically.

Preferably the controller signals the holding member.

In a preferred embodiment, signalling from the controller to disconnect the counterbalance from the holding member converts an electromagnet of a connecting portion of the holding member from an active state to an inactive state.

In another aspect of the first form, the load-adjusting device is further configurable between an unassisted configuration and an assisted configuration, to an impeded configuration. Preferably, in the impeded configuration, the counterbalance increases the load.

In another form the invention provides a locking device for selectively constraining a movable component of an exercise apparatus, suitable for use in a load-adjusting device of the first form.

The locking device according to this form of the invention comprises:

at least one first engaging member;

at least one second engaging member releasably engageable with the at least one first engaging member; and at least one actuator, wherein actuation of the at least one actuator facilitates configuration of the locking device to a locked configuration wherein the at least one first engaging member is releasably engaged with the at least one second engaging member, whereby movement of the movable component is constrained in at least a second direction with respect to the frame of the exercise apparatus, and substantially unconstrained in at least a first direction with respect to the frame of the exercise apparatus.

Preferably, the locking device is configurable to an unlocked configuration wherein the at least one first engaging member and the at least one second engaging member are disengaged, whereby movement of the movable component of the exercise apparatus is substantially unconstrained by the locking device in both the first direction and the second direction.

In one preferred embodiment, the first direction is substantially opposed to the second direction.

Preferably, the locking device facilitates movement of the movable component between a plurality of stopping positions with respect to the frame of an exercise apparatus.

Preferably, engagement of the at least one first engaging member with the at least one second engaging member facilitates stopping the movable component at the plurality of stopping positions.

Preferably, the at least one second engaging member is or comprises a plurality of second engaging portions. Preferably, the locking device comprises a first engaging member that is engageable with any one of the plurality of second engaging portions.

Preferably, when the first engaging member is engaged with any one of the plurality of second engaging portions, the movable component of the exercise apparatus can be stopped at a corresponding stopping position with respect to the frame of the exercise apparatus.

Preferably, when the locking device is in the unlocked configuration, the movable component can be moved in the first direction or the second direction with respect to the plurality of stopping positions.

Preferably, when the movable component is moved in the first direction with respect to the plurality of stopping positions, the first engaging member is moved in a first corresponding direction with respect to the plurality of second engaging portions.

Preferably, when the movable component is moved in the second direction with respect to the plurality of stopping positions, the first engaging member is moved in a second corresponding direction with respect to the plurality of second engaging portions.

Preferably, the first and second corresponding directions are substantially opposed. In one preferred embodiment the first and second corresponding directions are the same, or substantially the same, as the first and second directions, respectively.

Preferably, when the locking device is in the locked configuration, movement of the movable component in the first direction past any one of the stopping positions is constrained by constraint of movement of the first engaging member with respect to the second engaging portions in the first corresponding direction.

Preferably, when the locking device is in the locked configuration, movement of the movable component in the second direction past any one of the stopping positions is facilitated by substantially unconstrained movement of the first engaging member with respect to the second engaging portions in the second corresponding direction.

In a preferred aspect of the first form, the at least one first engaging member is a projection member; and the at least one second engaging member is a catch member.

In a preferred embodiment the projection member is located on the movable component of the exercise apparatus, and the catch member is located on the frame of the exercise apparatus.

In an alternative embodiment the catch member is located on the movable component of the exercise apparatus, and the projection member is located on the frame of the exercise apparatus.

Suitably, the at least one catch member is or comprises a plurality of catches. The catches may be, for example, openings, rails, or protrusions.

Preferably the projection member comprises a releasing engagement edge and a locking engagement edge.

In a preferred embodiment, when the locking engagement edge is engaged with any one of the catches, the locking edge is inclined relative to the catch. Preferably, the inclination of the locking edge urges the projection member towards the catch.

In a preferred embodiment, when the locking engagement edge is engaged with any one of the catches, the locking engagement edge is curved relative to the catch. Preferably, the curve of the locking engagement edge urges the projection member towards the catch.

In a preferred embodiment, when the locking engagement edge is engaged with any one of the catches, the locking engagement edge is substantially perpendicular relative to the catch. Preferably, the substantially perpendicular orientation of the locking engagement edge stabilises the position of the projection member with respect to the catch.

In a preferred embodiment, when the releasing engagement edge is engaged with any one of the catches, the releasing engagement edge is inclined relative to the catch. Preferably, the inclination of the releasing engagement edge urges the projection member away from the catch.

In a preferred embodiment, when the releasing engagement edge is engaged with any one of the catches, the releasing engagement edge is curved relative to the catch. Preferably, the curve of the releasing engagement edge urges the projection member away from the catch.

Preferably the at least one actuator of the locking device is capable of moving the projection member relative to the plurality of catches, whereby the projection member is urged to engage with the catches.

In a preferred embodiment, the actuator comprises an extension member. Preferably, extension of the extension member moves the projection member.

Preferably, the extension member moves the projection member rotatably. Alternatively, extension of the extension member may move the projection member linearly.

Preferably, when the projection member is engaged with any one of the catches, the application of a suitable force from the catch on the releasing edge of the projection member temporarily disengages the projection member from the catch, allowing movement of the projection member between the plurality of catches.

In preferred such embodiments wherein the actuator comprises an extension member, the application of a suitable force on the releasing edge of the projection member can temporarily return the extension member towards an unextended position.

Preferably, the locking device further comprises one or more controllers capable of signalling the one or more actuators. Preferably signalling from the controller operates the actuator. Preferably the controller signals the actuator electrically over wires. The controller may signal the actuator wirelessly. The controller may signal the actuator mechanically.

Preferably, the controller is mounted to the movable component of the exercise apparatus.

In a third form there is provided a load-adjusting device of the first form, comprising one or more locking devices of the second form. Preferably, the one or more load-adjusting devices and the one or more locking devices comprise a shared controller.

In fourth form there is provided an exercise apparatus with the load-adjusting device of the first or third forms located thereon.

In a fifth form, there is provided an exercise apparatus with the locking device of the third form located thereon.

In another form there is provided a method of adjusting a load movably mounted to an exercise apparatus, including the steps of:

operating a controller; and connecting a counterbalance to the load according to the operation of the controller, to thereby adjust the load.

In an embodiment of this method, connecting a counterbalance to the load includes the step of unlocking a locking device mounted to the counterbalance.

In an embodiment of this method, connecting a counterbalance to the load includes the step of disconnecting the counterbalance from a holding member.

In yet another form there is provided a method of selectively constraining the movement of a movable component of an exercise apparatus with respect to a frame of the exercise apparatus, including the steps of:

operating a controller; and configuring the engagement of at least one first engaging member with at least one second engaging member to a locked configuration according to the operation of the controller, whereby movement of a component of an exercise apparatus is constrained in at least a first direction and substantially unconstrained in at least a second direction.

In an embodiment of the method of this form, the movable component is constrained from movement between a plurality of stopping positions with respect to the frame of the exercise apparatus in the first direction, and substantially unconstrained from movement between the plurality of stopping positions with respect to the frame of the exercise apparatus in the second direction.

In an embodiment, the method further includes the steps of:

operating the controller; and configuring the engagement of the at least one first engaging member with the at least one second engaging member to an unlocked configuration according to the actuation of the actuator, whereby movement of the component of the exercise apparatus is substantially unconstrained in the first direction and the second direction.

Further features and advantages of the present invention will become apparent from the following detailed description.

DETAILED DESCRIPTION OF THE DRAWINGS

Figure 1:
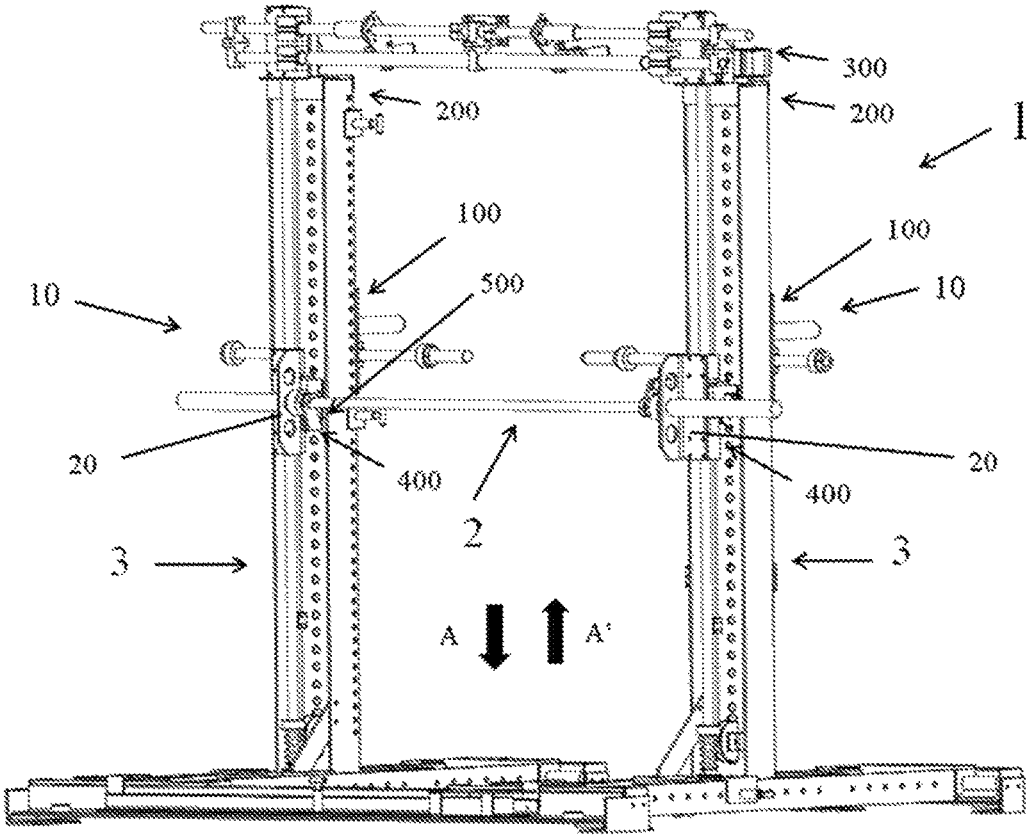
FIG. 1 is a front perspective view illustrating load-adjusting devices according to the invention located on an exercise apparatus.
Figure 2:
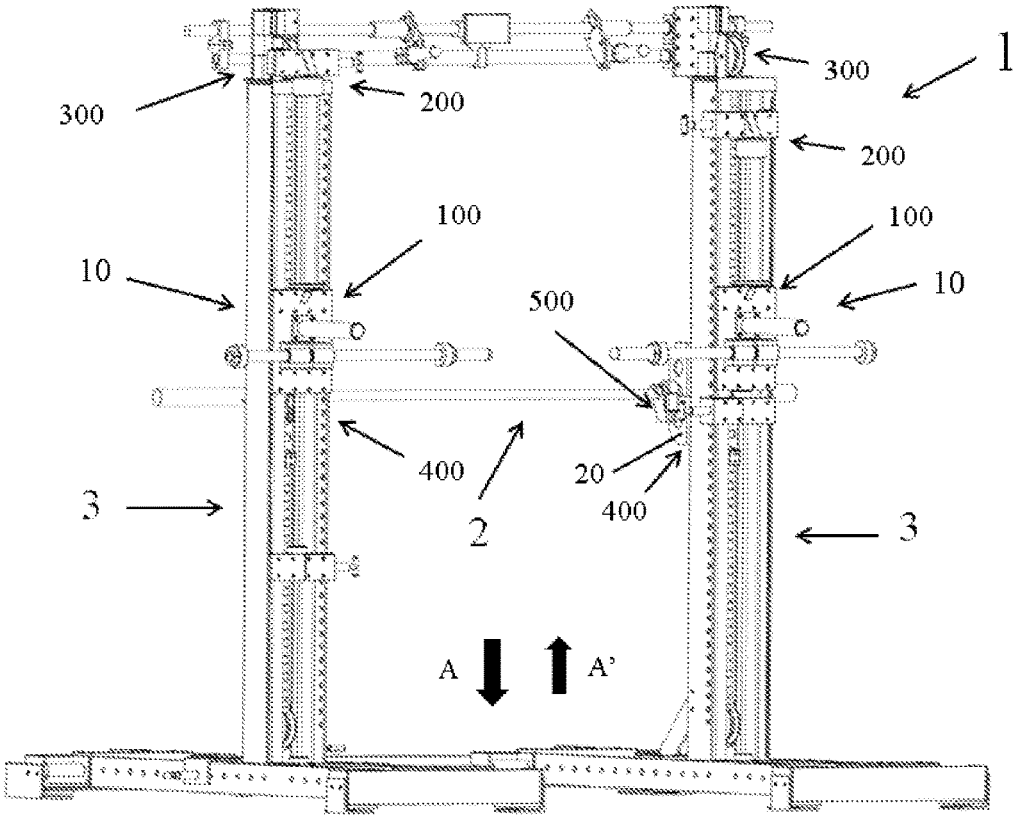
FIG. 2 is a rear perspective view illustrating the load-adjusting devices of FIG. 1 located on the exercise apparatus.

FIGS. 1 and 2 show a pair of load-adjusting devices 10 of the invention located on an exercise apparatus 1. Exercise apparatus 1 comprises a load in the form of user-engageable component 2 mounted to respective frames 3, which are spaced vertical members.

It will be appreciated that the load of exercise apparatus 1 can be increased, for example by adding weights to user-engageable component 2.

User-engageable component 2 of exercise apparatus 1 comprises a bar member that is adapted for engagement by a user, and paired mounting portions 20. User-engageable component 2 is slidably mounted to spaced vertical members 3 of exercise apparatus 1 by respective mounting portions 20. User-engageable component 2 is slidably movable in a first direction A towards the lower ends of vertical members 3, and slidably movable in a second direction A' towards the upper ends of vertical member 3.

Locking devices 101 of the invention, as hereinbelow described, are mounted to mounting portion 20 of user-engageable component 2.

The bar member of user-engageable component 2 is rotatable about its longitudinal axis with respect to mounting portions 20.

User-engageable component 2 of exercise apparatus 3 is particularly adapted for performing exercises such as bench presses, lunges, and squats, which involve a user engaging with the bar member of user-engageable component 2, and moving a load comprising user-engageable component 2 in the second direction A', away from the user.

It will be appreciated that load-adjusting device 10 of the invention can also be used with a range of other exercise apparatus. Although user-engageable component 2 of exercise apparatus 1 comprises a bar member that is engageable by a user, it will be appreciated that load-adjusting device 10 can be used with loads comprising other user-engageable components.

By way of non-limiting example, load-adjusting device 10 can be used with leg press apparatus wherein the user-engageable component may comprise a frame comprising a platform adapted for engagement by a user.

Furthermore, it will be appreciated that load-adjusting device 10 need not necessarily be used with a load comprising a user-engageable component, and may be used with any other suitable load mounted to a frame of an exercise apparatus.

As best seen in FIGS. 1 and 2, each of the respective load-adjusting devices 10 of the invention comprise counterbalance 100; holding member 200; pulley 300; and user-engageable component connecting member 400. However, it will be appreciated that, in other preferred embodiments such as set forth in FIG. 3, load adjusting devices 10 do not comprise holding member 200.

As pictured in the figures, paired load-adjusting devices 10 further comprise a shared controller 500. As pictured in the figures, operation of shared controller 500 signals each of respective load-adjusting devices 10, such that paired devices 10 operate in parallel with respect to user-engageable component 2 of exercise apparatus 1. However it will be appreciated that in other embodiments each device 10 may comprise an individual controller 500.

Figure 3:
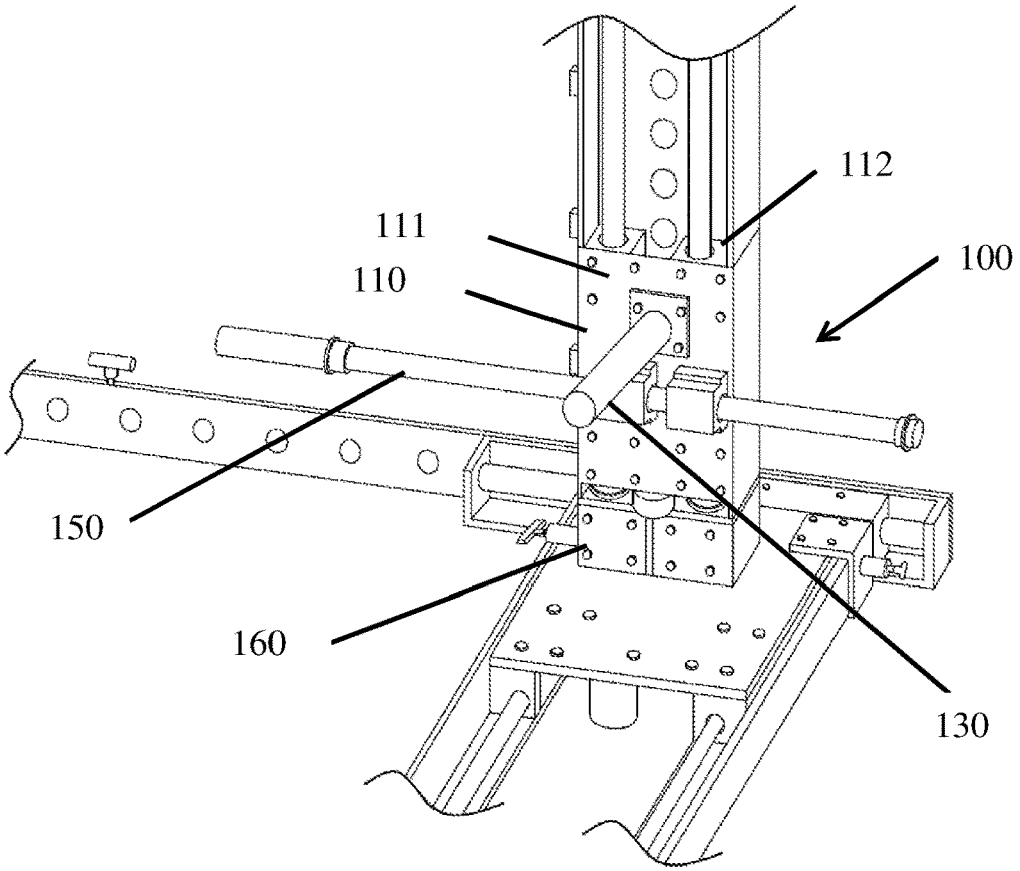
FIG. 3 is a close up perspective view illustrating a counterbalance of a load-adjusting device according to an embodiment of the invention.
Figure 4:
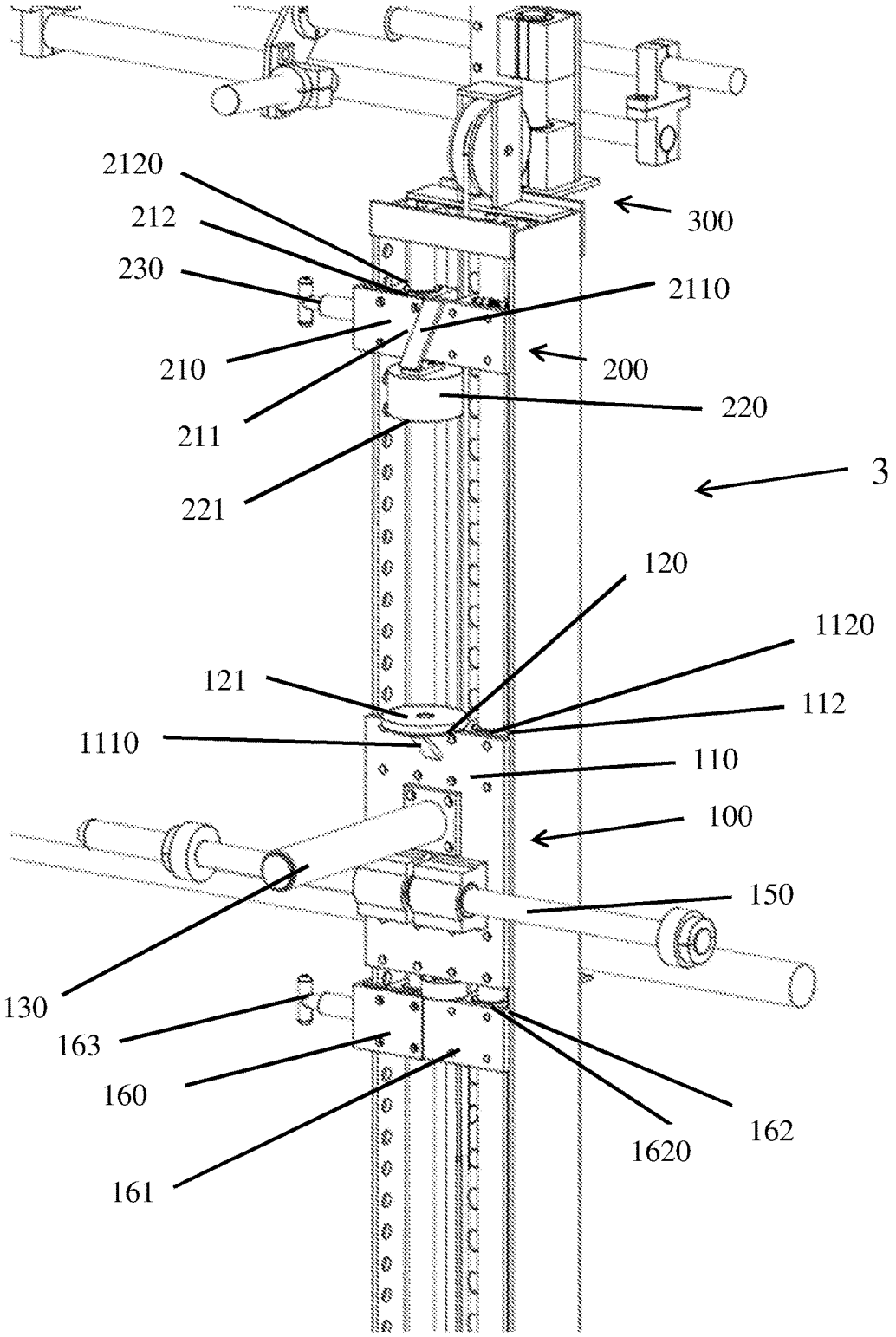
FIG. 4 is a close-up perspective view illustrating a counterbalance of the load-adjusting according to another embodiment of the invention.

Embodiments of counterbalance 100 are depicted in FIG. 3 and FIG. 4.

Counterbalance 100 comprises counterbalance mounting portion 110; and counterbalance receiving portion 130.

As best seen in FIG. 4, in one embodiment, counterbalance 100 further comprises counterbalance connecting portion 120.

As best seen in FIG. 3, in another embodiment, load-adjusting device does not comprise counterbalance connecting portion 120, and counterbalance 100 comprises a locking device 101, as hereinbelow described. It will be further appreciated that, in this embodiment load-adjusting device 10 does not comprise holding member 200.

Counterbalance mounting portion 110 comprises counterbalance plate 111, and paired counterbalance channel blocks 112. Paired counterbalance channel blocks 112 comprise respective channels 1120. In the embodiment depicted in FIG. 3, locking 101 device is mounted to counterbalance plate 111 on the same face as counterbalance channel blocks 112.

Counterbalance mounting portion 110 is slidably mounted to vertical member 3 of exercise apparatus 1. Respective counterbalance channel blocks 112 are slidably mounted to respective rails of the vertical member 3, with respective rails of vertical member 3 passing through respective channels 1120.

Counterbalance mounting portion is rigidly engaged (not shown) with connecting member 310 of pulley 300.

Counterbalance receiving portion 130 is in the form of a bar rigidly attached to counterbalance plate 111. Counterbalance receiving bar 130 extends substantially perpendicularly from counterbalance plate 111.

As best seen in FIG. 4, in an embodiment comprising counterbalance connecting portion 120, counterbalance connecting portion 120 is in the form of a circular armature plate comprising engaging face 121. Counterbalance engaging face 121 is substantially perpendicular to counterbalance plate 111. Counterbalance connecting portion is rigidly mounted to counterbalance plate 111 by angle member 1110.

As best seen FIGS. 3 and 4, counterbalance mounting portion further comprises user-engageable portion 150. Counterbalance user-engageable portion 150 is in the form of a bar slidably mounted by a pair of channel blocks to counterbalance plate 110.

As best seen in FIGS. 3 and 4, load-adjusting device 10 further comprises counterbalance accessory member 160.

Counterbalance accessory member 160 comprises counterbalance accessory member plate 161; counterbalance accessory member channel block 162; and counterbalance accessory member lock 163. Counterbalance accessory member 160 is slidably mounted to vertical member 3 of exercise apparatus 1 below counterbalance mounting portion, in a similar manner as counterbalance mounting portion 110.

As pictured in the figures lock 163 of counterbalance accessory member 160 is a retractable bolt locking mechanism. However, it will be appreciated that lock 163 can take other forms.

As best seen in FIG. 4, in an embodiment of load-adjusting device 10 comprising holding member 200, holding member 200 comprises holding member mounting portion 210; holding member connecting portion 220; and holding member lock 230.

Holding member mounting portion 210 comprises holding member plate 211, and paired holding member channel blocks 212. Paired holding member channel blocks 212 comprise respective channels 2120.

Holding member mounting portion 210 is slidably mounted to respective vertical member 3 of exercise apparatus 1 above counterbalance 100. Respective holding member channel blocks 212 are slidably mounted to respective rails of vertical member 3, with respective rails of vertical member 3 passing through respective channels 2120.

Holding member connecting portion 220 is in the form of an electromagnet comprising holding member engaging face 221. Holding member engaging face 221 is substantially perpendicular to holding member plate 211. Holding member connecting portion is rigidly mounted to holding member plate 211 by angle member 2110.

As pictured in FIG. 4, holding member lock 230 is a retractable bolt locking mechanism. However, it will be appreciated that holding member lock 230 can take other forms.

Figure 5:
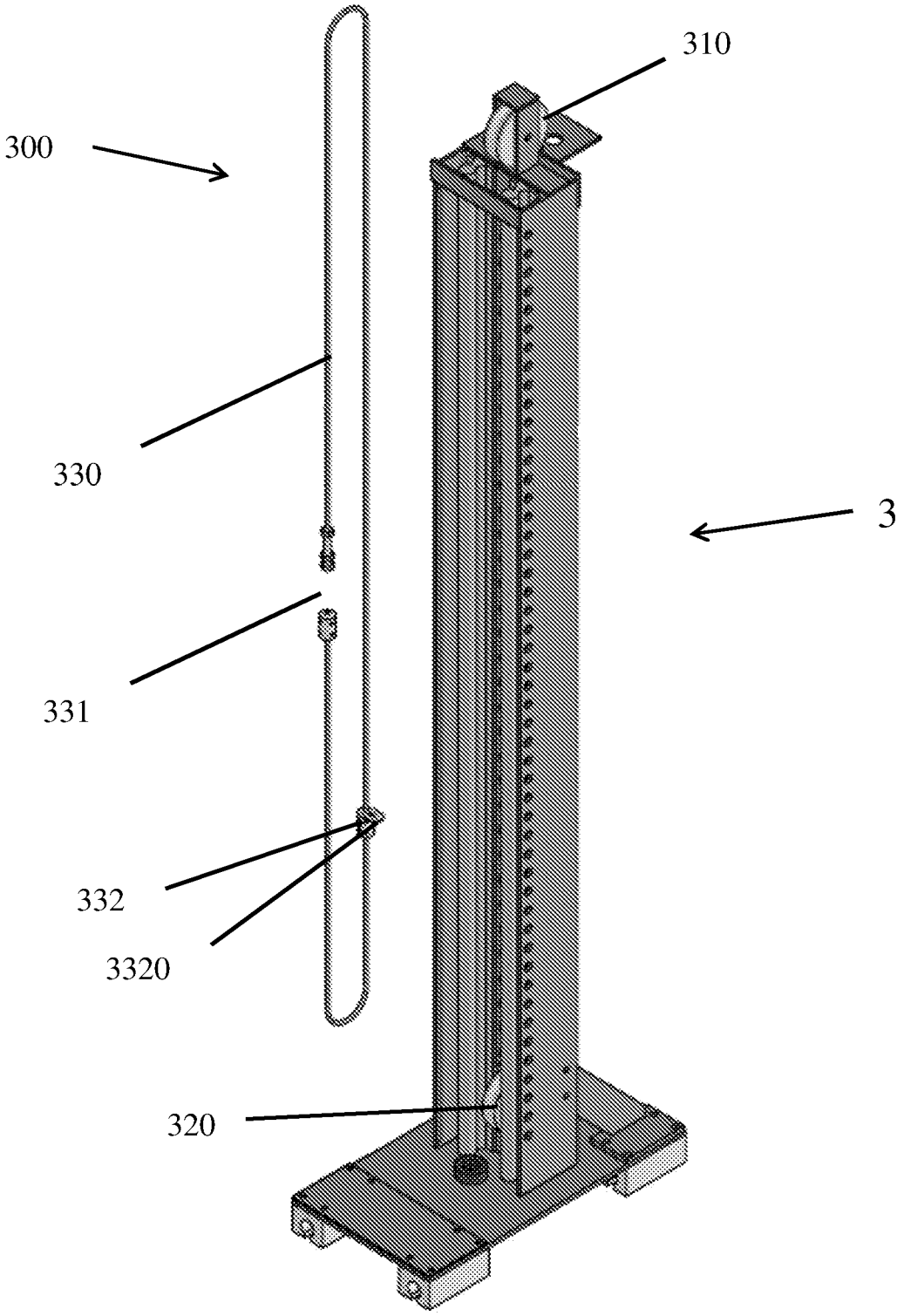
FIG. 5 is a partially disassembled view illustrating a pulley of the load-adjusting device of FIG. 1.

As best seen in FIG. 5, pulley 300 comprises: upper pulley wheel 310; lower pulley wheel 320; and pulley connecting member 330. As pictured in the figures, pulley connecting member 330 is in the form of a cable.

Upper pulley wheel 310 and lower pulley wheel 320 are mounted to vertical member 3 of exercise apparatus 1.

As best seen in FIG. 4, pulley cable 330 is mounted in a substantially elliptical fashion to upper pulley wheel 310 and lower pulley wheel 320.

Pulley cable 330 comprises counterbalance engaging portion 331; and a load engaging portion which is in the form of user-engageable component catch 332. Catch 332 comprises switch actuating projection 3320.

Counterbalance engaging portion 331 is rigidly engaged with mounting portion 110 of counterbalance 100.

Catch 332 of pulley cable 330 is releasably engageable with user-engageable component connecting member 400.

Figure 6:
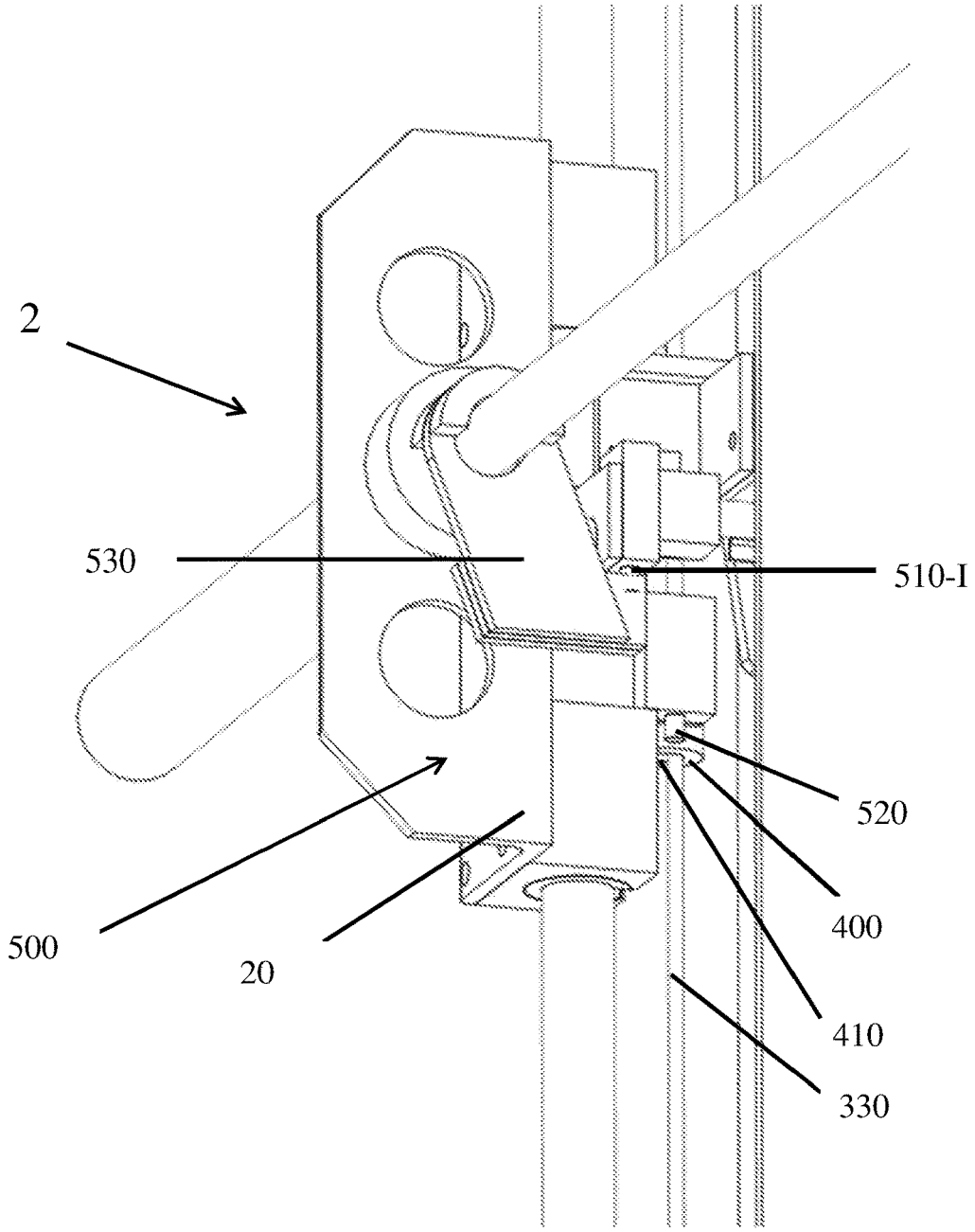
FIG. 6 is a close-up perspective view illustrating components of an embodiment of a controller of the load-adjusting devices and the locking devices of the invention.

As best seen in FIG. 6, User-engageable component connecting member 400 is a channel member comprising channel 410.

Pulley cable 330 passes through channel 410. User-engageable component connecting member 400 is releasably engageable with catch 332 of pulley cable 330.

User-engageable component connecting member 400 is rigidly mounted to mounting portion 20 of user-engageable component 2 of exercise apparatus 1.

Figure 7:
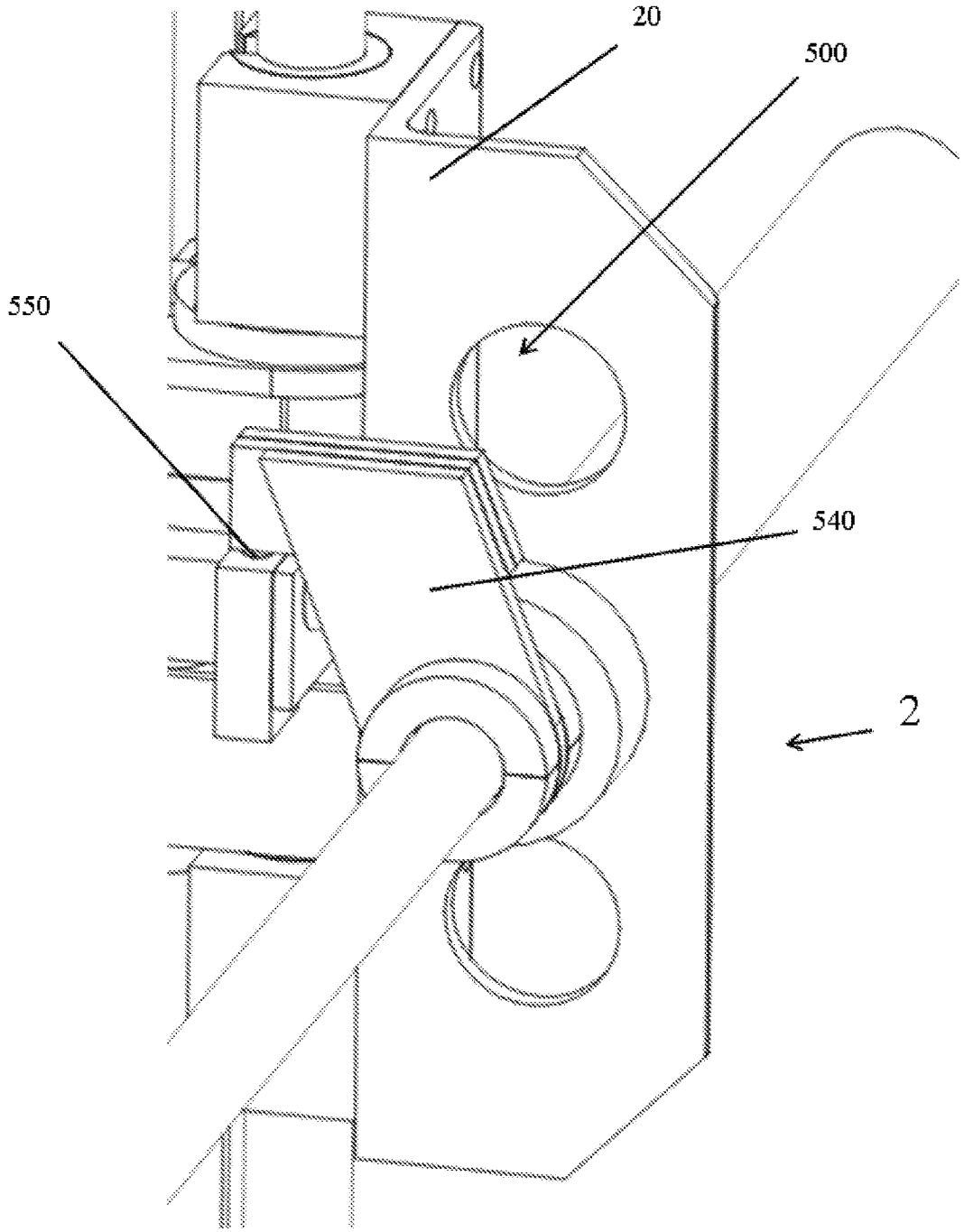
FIG. 7 is a close-up perspective view of additional components of the controller of FIG. 6.
Figure 8:
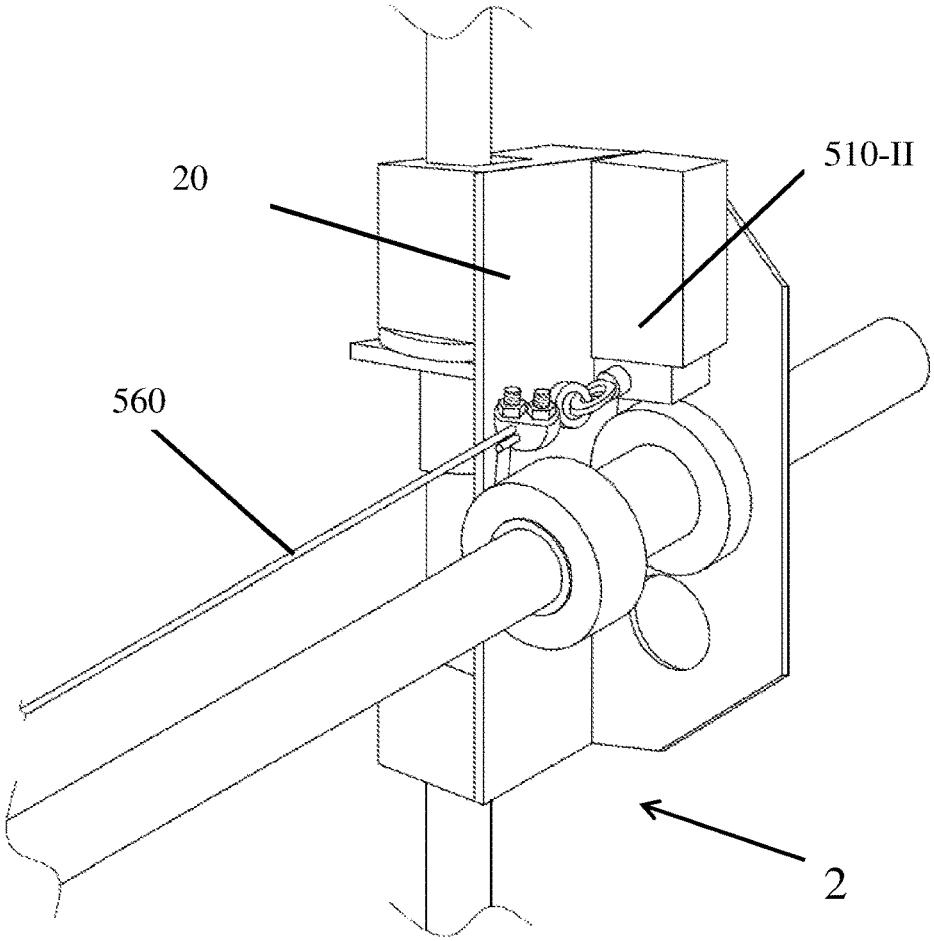
FIG. 8 is a close-up perspective view of components of another embodiment of a controller of the load adjusting devices and the locking devices of the invention.

As best seen in FIGS. 6-8, controller 500 comprises first switch 510 and second switch 520.

As best seen in FIGS. 6 and 7, in one embodiment, controller 500 further comprises first hammer 530; second hammer 540; and third switch 550.

Is this embodiment, first switch 510 is in a first form 510-I, and first switch 510-I; second switch 520; and third switch 550 are mounted to a mounting portion 20 of user-engageable component 2 of exercise apparatus 1.

Furthermore, first hammer 530 and second hammer 540 are mounted to the bar member of user-engageable component 2.

As depicted in FIGS. 6 and 7, first switch 510-I and second switch 520 are mounted to a first mounting portion 20 of user-engageable component 2, and third switch 550 is mounted to a second mounting portion 20 of user-engageable component 2.

Additionally, first hammer 530 is mounted to user-engageable component 2 near to the first mounting portion 20, and second hammer 540 is mounted near to the second mounting portion 20.

However, it will be appreciated that the particular arrangement of mounting of switches and hammers can be varied.

As depicted in FIG. 6, second switch 520 is mounted to mounting portion 20 separately from user-engageable component connecting member 400. However, it will be appreciated that in an alternative embodiment second switch 520 may be mounted to user-engageable component connecting member 400. In some such embodiments, catch 332 does not comprise switch actuating projection 3320.

As best seen in FIG. 8, in another embodiment, controller 500 further comprises cable actuator 560, but does not comprise first hammer 530, second hammer 540, or third switch 550. Cable actuator 560 extends between respective mounting portions 20 of user-engageable component 2 and is linked to first switch 510, which is in a second form 510-II.

In the embodiment depicted in FIG. 8, second switch 520 is mounted as depicted in FIG. 6.

In embodiments wherein counterbalance 100 comprises a locking device 101, controller 500 signals the locking device. Signalling from controller 500 can convert the locking device between a locked configuration and an unlocked configuration. Preferably, signalling occurs electrically over wires. Alternatively, signalling may occur wirelessly. In some embodiments, signalling may occur mechanically.

In embodiments wherein load-adjusting device 10 comprises holding member 200, controller 500 signals holding member 200 electrically. Signalling from controller 500 can convert electromagnet 220 of holding member 200 between an active state and an inactive state. Signalling from controller 500 can convert the locking device between a locked configuration and an unlocked configuration. Preferably, signalling occurs electrically over wires. Alternatively, signalling may occur wirelessly. In some embodiments, signalling may occur mechanically.

Furthermore, in embodiments wherein the load-adjusting device is connected to user-engageable component 2 wherein mounting portions 20 of user-engageable component 2 comprises a locking device 101, controller 500 may signal the locking device, e.g. over wires or wirelessly. Signalling from 500 may convert locking device between a locked configuration and an unlocked configuration.

In use, load-adjusting device 10 is configurable between an unassisted configuration and an assisted configuration.

In the unassisted configuration, counterbalance 100 is not in operative connection with user-engageable component 2.

In the assisted configuration, counterbalance 100 is in operative connection with user-engageable component 2.

In the unassisted configuration, the load in the form of user-engageable component 2 is substantially unaffected by load-adjusting device 10, and the force required from a user to move user-engageable component 2 in the second direction A' is substantially unaffected.

In the assisted configuration, the load in the form of user-engageable component 2 is reduced by load-adjusting device 10, and the force required from a user to move user-engageable component 2 in the second direction A' is reduced.

In use, in the unassisted configuration, user-engageable component connecting member 400 is disengaged with catch 332 of pulley cable 330, and counterbalance 100 is disconnected from user-engageable component 2.

In use, in the assisted configuration, user-engageable component connecting member 400 is engaged with catch 332 of pulley cable 330, and counterbalance 100 is connected with component 2 via user-engageable component connecting member 400.

In use, in embodiments such as depicted in FIG. 3, wherein counterbalance 100 comprises a locking device, in the unassisted configuration, locking device is in a locked configuration.

When the locking device is in the locked configuration, counterbalance 100 is constrained from movement in the first direction A relative to vertical member 3.

In use, in embodiments such as depicted in FIG. 4, wherein load-adjusting device comprises holding member 200, in the unassisted configuration, holding member connecting portion 220, which is an electromagnet, is in an active state, and counterbalance engaging face 121 is thereby stably engaged with holding member engaging face 221, via electromagnetic attraction.

When counterbalance engaging face 121 is stably engaged with holding member connecting face 221, holding member 100 and holding member 200 are stably connected, and counterbalance 100 is substantially stationary relative to vertical member 3.

In use, in embodiments wherein counterbalance 100 comprises locking device 101, in the assisted configuration, locking device 101 is in an unlocked configuration.

When locking device 101 is in the unlocked configuration, counterbalance 100 is movable relative to vertical member 3 in the first and second directions A and A'.

In use, in embodiments wherein load-adjusting device comprises holding member 200, in the assisted configuration, holding member connecting portion 220 is in an inactive state, and counterbalance connecting face 121 is disengaged with holding member engaging face 221.

When counterbalance connecting face 121 is disengaged with holding member engaging face 221, counterbalance 100 and holding member 200 are disconnected, and counterbalance 100 is movable in the relative to vertical member 3 in the first and second directions A and A'.

In use, in the assisted configuration, counterbalance 100 applies a force in the second direction A' through pulley cable 330 to user-engageable component 2, via the engagement of connecting member 400 with catch 332.

In use, operation of controller 500 can configure load-adjusting device 10 from the unassisted configuration to the assisted configuration.

Configuration of load-adjusting device from the unassisted configuration to the assisted configuration requires actuation of first switch 510 and second switch 520.

In use, in embodiments of controller 500 as illustrated in FIGS. 6 and 7, first switch 510-I can be actuated by rotation of user-engageable component 2 in a first direction about its longitudinal axis whereby hammer 530 engages first switch 510-I. Additionally, first switch can be released by rotation of user-engageable component 2 in a second direction opposed to the first direction, whereby first hammer 530 disengages with first switch 510-I. Furthermore, rotation of user-engageable component 2 in the second direction can actuate third switch 550, by engagement of third switch 550 with second hammer 540.

In use, in embodiments wherein controller 500 comprises cable actuator 560, first switch 510-II can be actuated by pulling cable actuator towards the bar member of user-engageable component 2. Additionally, first switch 510-II can be released by releasing cable actuator 560, wherein cable actuator 560 returns to a position away from the bar member.

In use, second switch 520 can be actuated by slidable movement of user-engageable component 2 and controller 500 mounted thereto in the first direction A towards the lower end of vertical member 3, whereby second switch 520 is engaged by switch actuation projection 3320 of catch 332 of pulley cable 300.

Furthermore, when second switch 520 is actuated by switch actuation projection 3320 of catch 332, user-engageable component connecting member 400 is engaged with catch 332 of pulley 330, wherein user-engageable component 2 is connected with counterbalance 100.

In use, in embodiments of load-adjusting device 10 wherein counterbalance 100 comprises locking device 101, the combination of actuation of first switch 510 and second switch 520 converts the locking device from a locked to an unlocked configuration.

Furthermore, in use, in embodiments wherein mounting portions 20 of user-engageable component 2 comprises locking devices 101 as depicted in FIG. 1, in use, actuation of switch 510 alone converts the locking device from an locked to an unlocked configuration.

It will therefore be appreciated that, in embodiments wherein both counterbalances 100 and user-engageable component 2 comprise locking devices 101, actuation of both first switch 510 and second switch 520 is required to unlock the locking devices of counterbalances 100, whereas actuation of first switch 510 alone unlocks the locking devices of user-engageable component 2.

In use, in embodiments of load-adjusting device 10 wherein counterbalance 100 comprises locking device 101, release of switch 510 and/or, in embodiments as depicted in FIGS. 6 and 7, actuation of third switch 540, converts locking device 101 from the unlocked configuration to the locked configuration.

Similarly, in use, in embodiments wherein mounting portion 20 of user-engageable component 2 comprise locking devices 101 as depicted in FIG. 1, release of switch 510 and/or, in embodiments as depicted in FIGS. 6 and 7, actuation of third switch 550 locks the locking devices.

It will therefore be appreciated that, in embodiments wherein both counterbalances 100 and user-engageable component 2 comprise locking devices 101, the same actuation of switches of controller 500 locks the locking devices of the counterbalances 100 and the user-engageable component 2.

In embodiments of load-adjusting device 10 comprising holding member 200 such as depicted in FIG. 4, in use, release of first switch 510 converts electromagnet 220 from the inactive state to the active state.

In use, when electromagnet 220 is in the active state, counterbalance 100 can be returned to stable engagement with holding member 100 whereby load-adjusting device 10 is returned to the unassisted configuration.

In use, when electromagnet 220 is in the active state, movement of user-engageable component 2 in the second direction A' towards a user can engage counterbalance engaging face 221 with holding member engaging face 121, and thereby return counterbalance 100 to stable engagement with holding member 200.

In use, the position of holding member 200 can be adjusted by slidable movement relative to vertical member 3, and the position of holding member 200 relative to vertical member 300 can be secured using lock 230.

In use, the position of counterbalance accessory member 160 can be adjusted by slidable movement relative to vertical member 3, and the position of counterbalance accessory member 160 relative to vertical member 300 can be secured using lock 163.

Advantageously, load-adjusting device 10 is configurable between an unassisted configuration and an assisted configuration. Advantageously, in the assisted configuration, the force required to move component 2 in the first direction A is substantially reduced.

Advantageously, the use of load-adjusting device 10 in the assisted configuration facilitates movement of user-engageable component 2 in the second direction A' by a user for whom movement of user-engageable component 2 in the second direction A' would otherwise be substantially difficult or impossible. By way of one non-limiting example, in the assisted configuration user-engageable component 2 may be movable by an elderly user or a user recovering from injury.

By way of another non-limiting example, in the assisted configuration user-engageable component 2 may be movable by a user who has performed sets of exercises with user-engageable component 2, and is thereby substantially fatigued and temporarily lacks the capacity to move user-engageable component 2 in the second direction A'.

Advantageously, load-adjusting device 10 can reduce or obviate the need for an assistant or spotter when exercises are performed using user-engageable component 2 of exercise apparatus 1.

Advantageously, controller 500 allows configuration of load-adjusting device 10 to the assisted configuration during use of exercise apparatus 1 by a user.

Advantageously, load-adjusting device 10 is adapted such that switch 520 is actuated by slidable movement of user-engageable component 2 in the first direction A towards the lower end of vertical member 3, whereby second switch 520 is engaged by switch actuation projection 3320 of catch 332 of pulley cable 300.

Advantageously, during exercise performed by a user with user-engageable component 2 involving movement of user-engageable component 2 away from the user in second direction A', when a user tires, slidable movement of user-engageable component 2 in the first direction A towards the user actuates switch 520, which can convert load-adjusting device 10 to the assisted configuration.

Advantageously, when second switch 520 is actuated by actuation projection 3320 of catch 332, user-engageable component connecting member 400 is engaged with catch 332 of pulley 330, wherein user-engageable component 2 is connected with counterbalance 100.

Connection of user-engageable component 2 with counterbalance 100 when second switch 520 is actuated and counterbalance 100 is disconnected from holding member 200 is advantageous, as this avoids jolting or jarring forces on user-engageable component 2 that may occur if counterbalance 100 is disconnected from holding member 200 when user-engageable component 2 is not connected with counterbalance 100, as hereinbelow described.

Advantageously, the force exerted by counterbalance 100 on user-engageable component 2 in the assisted configuration can be modified. Advantageously, counterbalance load receiving portion 130 is adapted to receive one or more weights, whereby the force exerted by counterbalance 100 on component 2 in the assisted configuration is modified.

Advantageously, load-adjusting device 10 can be used in a 'reverse' manner by a user. It will be readily understood by the skilled person that a user may perform exercises with exercise apparatus 1 wherein the user engages with counterbalance user-engageable portion 150, and slidably moves counterbalance 100 away from the user in the second direction A'.

When a user performs exercises with exercise apparatus 1 in this fashion, load-adjusting device 10 can be used in the 'reverse' manner, wherein counterbalance 100 acts as the load, and user-engageable component 2 acts as the counterbalance.

Advantageously, in some embodiments, controller 500 may signal locking device 101 mounted to user-engageable component 2 for restraining the load against vertical member 3. Such embodiments are advantageous, as they allow for restraining of the load and configuration of the load-adjusting device 10 using the same controller.

As herein described, in some embodiments, counterbalance 100 comprises a locking device for constraining movement of counterbalance 100 against vertical member 3. Such embodiments may be advantageous for facilitating stabilizing counterbalance 100 in a range of positions along vertical member 3, without requiring engagement with holding member 200 for stabilization of counterbalance 100.

Additionally, embodiments wherein counterbalance 100 comprises a locking device and controller 500 comprises cable actuator 560, can be particularly advantageous. It will be appreciated that, in such embodiments, where a user loses contact with the bar member of user-engageable component 2 while load-adjusting device is in the assisted configuration, release of cable actuator 560 will lock counterbalance 100, which will in turn restrain user-engageable component 2 from movement. This can be advantageous for safety reasons.

Furthermore, such embodiments wherein, additionally, user-engageable component 2 comprises a locking device, and controller 500 signals the locking device, can be particularly advantageous. It will be appreciated that, in such embodiments, where a user loses contact with the bar member of user-engageable component 2, release of cable actuator 560 will lock both counterbalance 100 and user-engageable component.

Advantageously, load-adjusting devices of the invention are suitable for use with a wide variety of exercise apparatus.

It will be readily understood by the skilled person that a load-adjusting device of the invention can be used to reduce the force required to move a user-engageable component of an exercise apparatus in directions other than a substantially vertical direction, as described herein in relation to use of device 10 for exercise apparatus 1.

The skilled person will readily understand that a load-adjusting device of the invention can be used with any suitable exercise apparatus to reduce the force required to move a load in any suitable direction.

By way of non-limiting example, in one alternative embodiment, a device of the invention can be used with a leg press apparatus. In one preferred form of this embodiment, the load-adjusting device can reduce the force required to move a user-engageable component in an upwardly inclined direction.

It will also be appreciated that actuation of second switch 520 does not necessarily require engagement of second switch 520 by projection 3320 of catch 332 of pulley cable 300.

If second switch 520 is actuated when counterbalance 100 is not connected with user-engageable component 2, upon release of counterbalance 100, catch 332 is brought into engagement with user-engageable component connection member 400.

In the embodiment of load-adjusting device 10 depicted in the figures, actuation of second switch 520 when counterbalance 100 is not connected with user-engageable component 2 can exert jolting or jarring forces on user-engageable component 2. Therefore, load-adjusting device is not adapted for actuation of second switch 520 when counterbalance 100 is not connected with user-engageable component 2.

However, it will be appreciated that in other embodiments, load-adjusting device 10 may be adapted for actuation of second switch 520 when counterbalance 100 is not connected with user-engageable component 2.

Furthermore, although in the embodiment of load-adjusting device 10 depicted in the figures connection of user-engageable component 2 with pulley 300 occurs via engagement of user-engageable component 2 with catch 332 via user-engageable component 400, it will be appreciated that in other embodiments engagement of user-engageable component 2 with pulley 300 can take other forms.

By way of example, in one such embodiment, load-adjusting device 10 may further comprise an actuator, such as a clamping actuator, located on user-engageable component 2 and/or counterbalance 100. Preferably, operation of the controller can actuate the actuator which facilitates engagement of user-engageable component 2 and/or counterbalance 100 with pulley connecting member 330, and connection of user-engageable 2 with counterbalance 100 via pulley 300.

As hereinabove described, in some embodiments, user-engageable component 2 of exercise apparatus 1 to which load-adjusting device 10 is mounted may comprise locking device 101. Furthermore, as hereinabove described, in some embodiments, counterbalance 100 may comprise locking device 101. Embodiments of locking device 101 are described in detail as follows.

Figure 9:
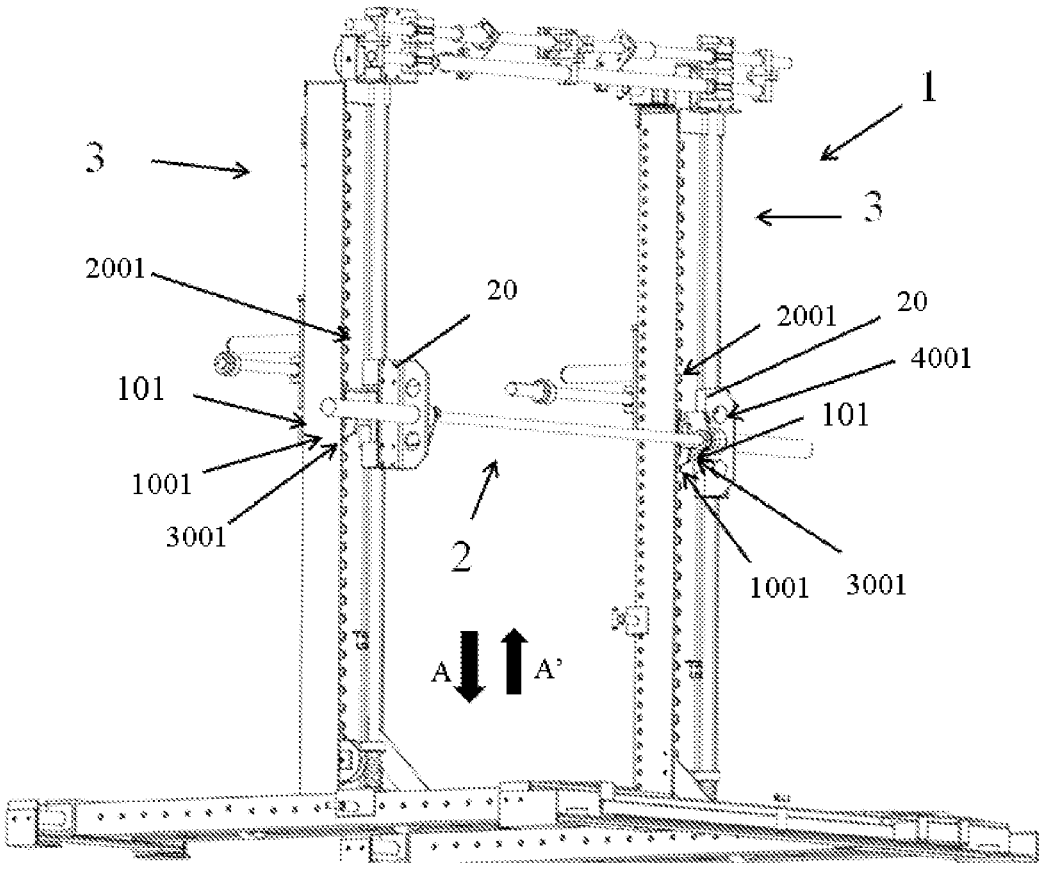
FIG. 9 is a perspective view of locking devices according to an embodiment of the invention mounted to a movable component of the exercise apparatus of FIG. 1.

FIG. 9 illustrates a pair of locking devices 101 mounted to mounting portion 20 of user-engageable component 2 of exercise apparatus 1. A further pair of locking devices 101 are mounted to counterbalance 100 of load-adjusting device 10, which is mounted to exercise apparatus 1 as described previously.

As hereinabove described, user-engageable component 2 is slidably movable in a first direction A towards the lower ends of vertical members 3, and slidably movable in a second direction A' towards the upper ends of vertical member 3.

It will be appreciated that locking device 101 of the invention need not necessarily be used with a load-adjusting device of the exercise apparatus as depicted in FIG. 9, but can also be used with a range of movable components and on a range of exercise apparatus. It will also be appreciated that although user-engageable component 2 of exercise apparatus 1 comprises a bar member that is engageable by a user, locking device 101 can be used with user-engageable components that do not comprise bar members.

By way of non-limiting example, locking device 101 can be used with leg press apparatus wherein the movable component may comprise a frame comprising a user-engageable platform.

It will be further appreciated that locking device 101 need not necessarily be used with a user-engageable component, and can also be used with any suitable movable component of an exercise apparatus.

Figure 10:
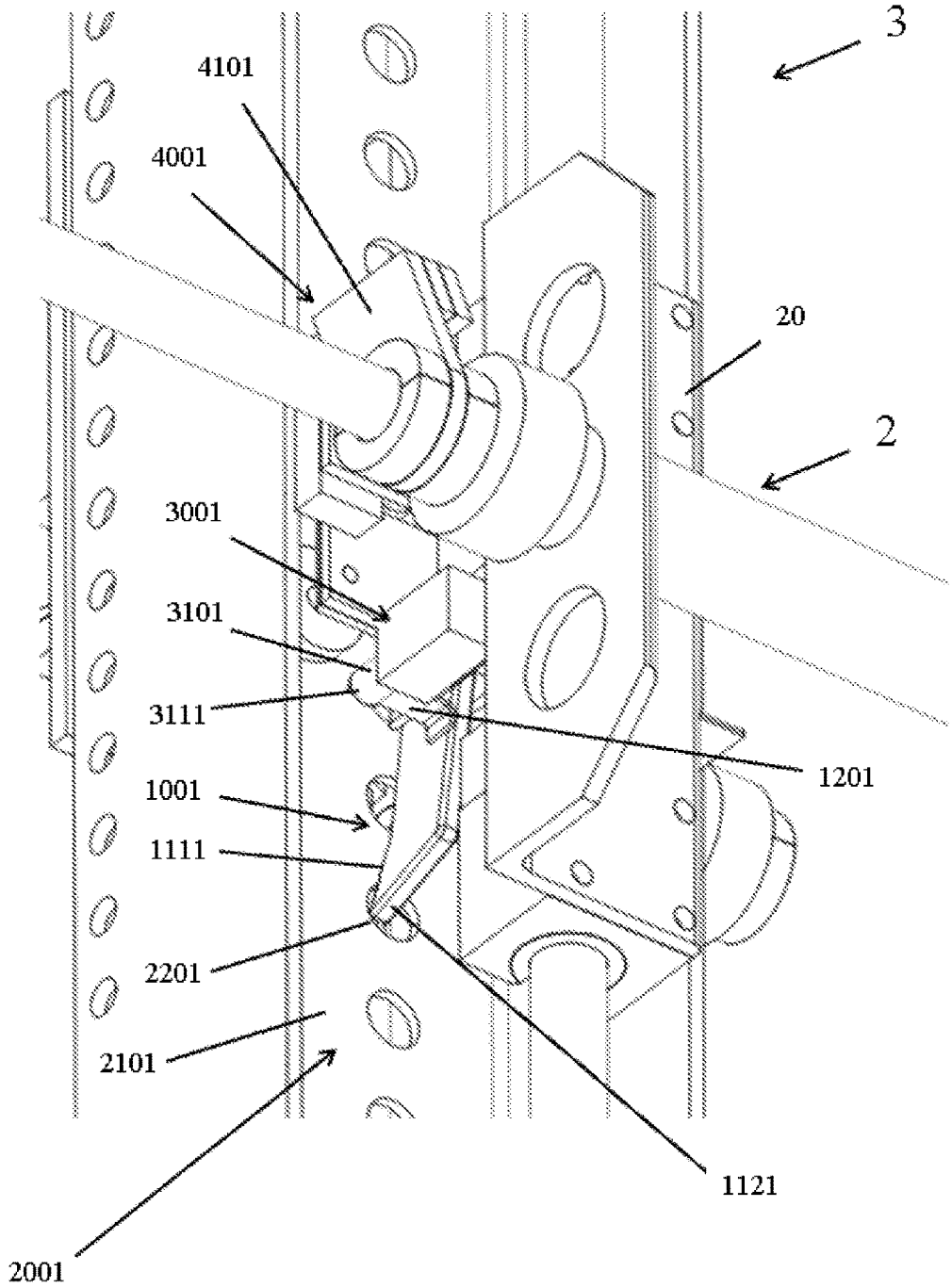
FIG. 10 is a close up lower perspective view illustrating components of a locking device depicted in FIG. 9.
Figure 12:
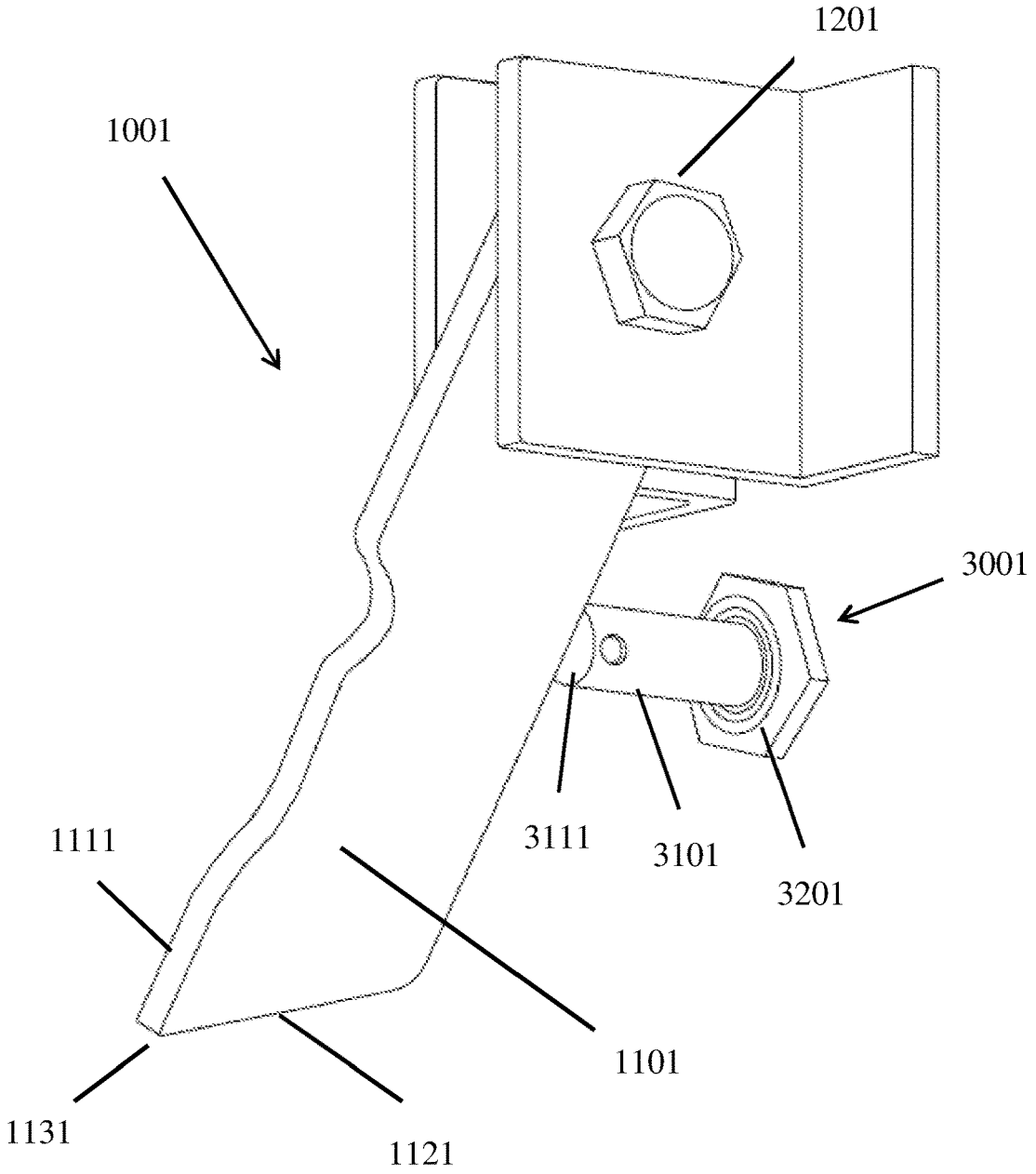
FIG. 12 is a close up perspective view illustrating components of a locking device mounted to a counterbalance of a load-adjusting device according to another embodiment of the invention.

As best seen in FIGS. 10 and 12, each of the respective locking devices 101 of the invention comprise a first engaging member in the form of projection member 1001; a second engaging member in the form of catch member 2001; and an actuator in the form of linear solenoid 3001.

As pictured in the figures, locking devices 101 are controlled using a shared controller 500 as hereinabove described. However it will be appreciated that in other embodiments devices 101 may comprise individual controllers.

Figure 11:
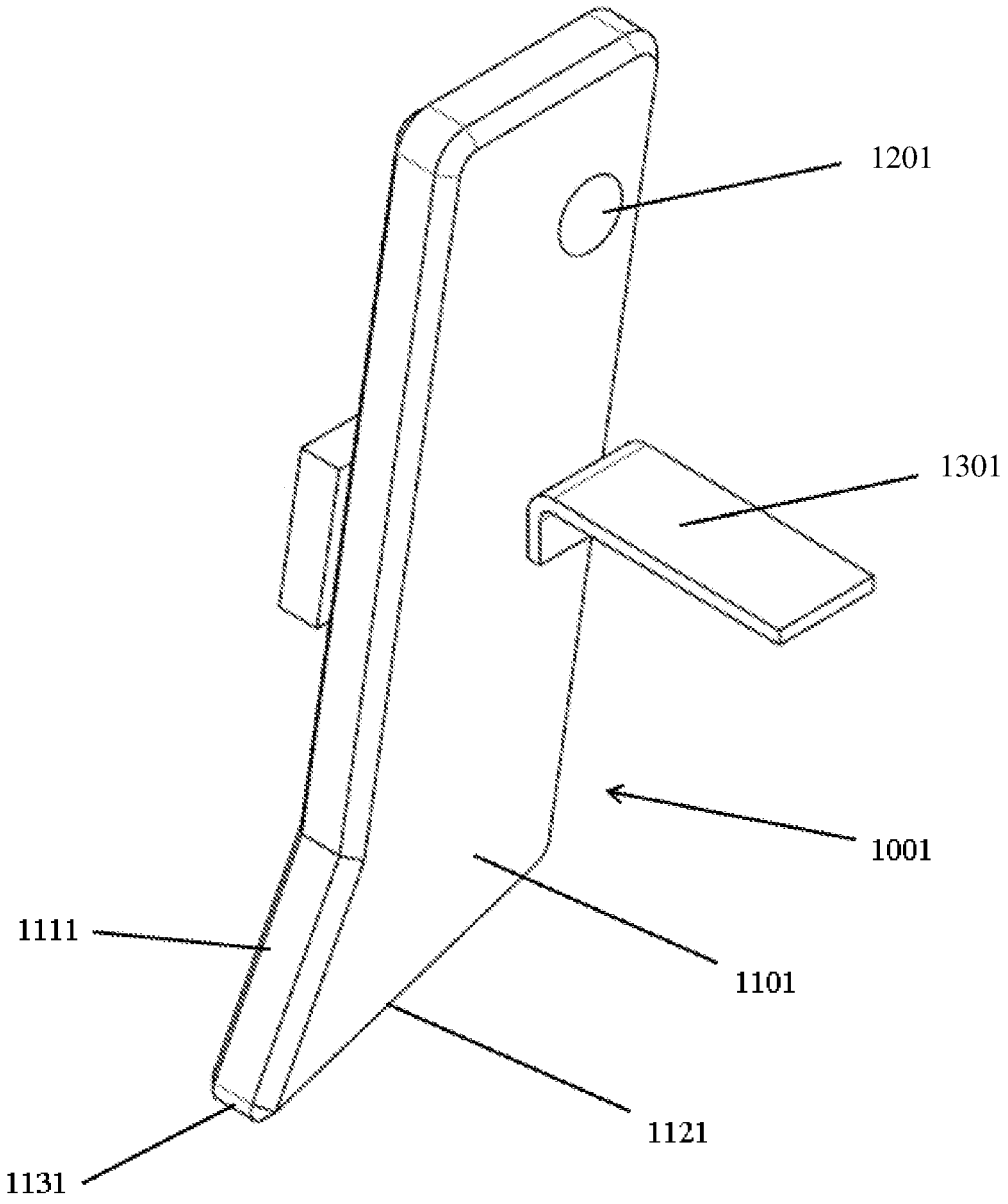
FIG. 11 is a close up perspective view of a projection member of the locking device depicted in FIG. 10.

FIGS. 11 and 12 illustrate embodiments of projection member 1001 of locking device 101.

FIG. 11 illustrates projection member 1001 of an embodiment of locking device 101 which is mounted to mounting portion 20 of user-egageable component 2 of exercise apparatus 1.

FIG. 12 illustrates projection member 1001 of an embodiment of locking device 101 which is mounted to counterbalance 100 of load-adjusting device 10.

As depicted in FIGS. 11 and 12, projection member 1001 comprises projection portion 1101; and mounting aperture 1201. As depicted in FIG. 11, projection member 1001 may further comprise actuator engaging portion 1301.

Projection portion 1101 comprises releasing edge 1111 and locking edge 1121. Releasing edge 1111 and locking edge 1121 converge at projection tip 1131.

As depicted in FIG. 10, mounting aperture 130 of projection member 100 is rotatably mounted to mounting portion 20 of user-engageable component 2 of exercise apparatus 1, e.g. via a suitable fastener such as a bolt or screw.

As depicted in FIG. 12, mounting aperture 130 is rotatably mounted to counterbalance plate 111 of counterbalance 100 by support brackets, on the same face of counterbalance 100 as counterbalance channels 112.

As best seen in FIG. 10, catch member 2001 comprises engaging face 2101 comprising a plurality of catches 2201, which are apertures.

Catch member 2001 is mounted internally to vertical member 3 of exercise apparatus 1. Catches 2201 of catch member 2001 are stationary with respect to vertical member 3 of exercise apparatus 1.

As best seen in FIGS. 10 and 12, solenoid 3001 comprises extension member 3101; and biasing portion 3201. Preferably, biasing portion 3201 is a spring.

The longitudinal axis of extension member 3101 is substantially perpendicular to catch member engaging face 2101.

Extension member 3101 comprises projection member-engaging end 3111 which may be a fork (not shown), as in the embodiment depicted in FIG. 11.

In the embodiment depicted in FIG. 11, projection member-engaging end 3111 engages with actuator engaging portion 1201 of projection member 1001 via a suitable fastener such as a bolt or pin (not shown).

However, as in the embodiment depicted in FIG. 12, projection member-engaging end 3111 need not be fastened to projection member 1001. Suitably, the arrangement between projection member 1001 and linear solenoid 3001 is such that movement of extension and retraction of linear solenoid moves projection member 1101.

In the embodiment of locking device 101 illustrated in FIG. 10 actuator 3001 is mounted to mounting portion 20 of user-engageable component 2 of exercise apparatus 1.

In the embodiment of locking device 101 illustrated in FIG. 12, actuator 3001 is mounted to counterbalance plate 111 of counterbalance 100.

In use, controller 500 signals locking devices 101 as hereinabove described. Specifically, controller 500 signals linear solenoids 3001 of locking devices 101.

In particular, as hereinabove described it will be appreciated that signalling from controller 500 to convert the locking devices 101 which are mounted to counterbalance 100 from the locked configuration to the unlocked configuration requires actuation of first switch 510 and second switch 520. However, it will be appreciated that signalling to convert the locking devices which are mounted to mounting portion 20 of user-engageable component 2 requires actuation of first switch 510 only.

It will be further appreciated that signalling from controller 500 to convert locking devices 101 mounted to counterbalance 100 and the locking devices 101 mounted to mounting portion 20 of user-engageable component 2 requires release of first switch 510, and/or, in embodiments of controller 500 depicted in FIGS. 6 and 7, actuation of third switch 550.

In use, signalling of solenoid 3001 by controller 500 modifies the conformation of solenoid 3001 between an unextended position in which extension member 3101 is unextended, and an extended position in which extension member 3101 is extended towards engaging face 2101 of catch member 200.

In the extended position, extension member 3101 is biased towards extension by biasing portion 3201, which may be in the form of a spring (not shown).

As depicted in the Figures, solenoid 3001 is activated in the unextended position, and inactivated in the extended position. However, it will be appreciated that this can be varied as desired.

When solenoid 3001 is in the unextended position, upon signalling of solenoid 3001 by controller 500, movement of extension member 3101 rotates projection portion 1101 of projection member 1001 proximally towards engaging face 2101 of catch member 2001.

In use, when projection portion 1101 is located proximal with engaging face 2101, projection portion 1101 can engage with any one of catches 2201. When projection portion 1101 is engaged with any one of catches 2201, engaging tip 1131 is angled downwardly with respect to vertical member 3, and releasing edge 1111 and locking edge 1121 are inclined relative to catch 2201.

When actuator 3001 is in the extended position and projection portion 1101 is engaged with any one of catches 2201, locking device 10 is in the locked configuration.

In use, when actuator 3001 is in the extended position, upon signalling of solenoid 3001 by controller 500, movement of extension member 3101 rotates projection portion 1101 of projection member 1001 distally away from engaging face 2101 of catch member 2001.

Movement of projection member 1101 distally away from projection member 1001 can disengage projection member 1101 from any one of catches 2201. When actuator 3001 is in the unextended position and projection portion 1101 is located distally away from engaging face 2101, locking device 101 is in the unlocked configuration.

In use, when locking device 101 is in the locked configuration such that projection portion 1101 is engaged with any one of catches 2201, a force applied to user-engageable component 2, or counterbalance 100, respectively, in first direction A towards the lower end of vertical members 3 of exercise apparatus 1 engages locking edge 1121 of projection portion 1101 with a lower internal edge of catch 2201.

In use, when locking edge 1121 engages with the lower internal edge of catch 2201, the inclined angle of locking edge 1121 with respect to catch 220 urges projection member 1001 towards catch 220 and extension member 3101 of actuator 300 remains in the extended position, whereby user-engageable component 2, or counterbalance 100, respectively, is constrained from movement in the first direction.

In use, when locking device 101 is in the locked configuration and projection portion 1101 is engaged with any one of catches 2201, a force applied to user-engageable component 2 in second direction A' towards the upper end of vertical members 3 engages releasing edge 1111 of projection portion 1101 with an upper internal edge of catch 2201.

In use, when releasing edge 1121 engages with the upper internal edge of catch 2201, the inclined angle of releasing edge 1121 with respect to catch 2201 urges projection member 1001 away from catch 2201 and extension member 3101 of actuator 3001 is temporarily moved towards the unextended position. Temporary movement of projection member 1001 towards the unextended position facilitates release of projection member 1001 from catch 2201, whereby user-engageable component 2, or counterbalance 100, respectively, can be moved in the second direction A' towards the upper end of vertical member 3.

Advantageously, locking device 101 is capable of selectively constraining movement of user-engageable component 2, and counterbalances 100, of exercise apparatus 1.

Advantageously, when projection member 1001 is engaged with any one of catches 2201 of projection member

2001, user-engageable component 2 and counterbalances 100 of exercise apparatus 1 are constrained from movement in the first direction A towards lower ends of vertical members 3 of exercise apparatus 1, and substantially unconstrained from movement in the second direction A' towards upper ends of vertical members 3 of exercise apparatus 1.

In particular regard to user-engageable component 2, such selective constraint can be particularly beneficial when a user is performing exercise with exercise apparatus 1 that requires moving user-engageable component 2 away from the user. By way of non-limiting example, when a user is performing exercise such as bench presses, squats, or lunges using the bar member of user-engageable component 2, such selective constraint by locking device 10 prevents movement of user-engageable component 2 in the first direction towards the user, but allows movement of user-engageable component 2 in the second direction away from the user.

Advantageously, a user can configure locking devices 10 between the locked configuration and the unlocked configuration conveniently during use of apparatus 1, via controller 500. This can be particularly advantageous in scenarios wherein user-engageable component 2 is heavy or carrying a heavy load, and/or wherein a user is performing repeated exercises or sets wherein user-engageable component 2 is being moved in the second direction A'.

By way of non-limiting example, when a user cannot easily move user-engageable component 2 in the second direction A' during such exercise, controller 500 can be used to engage projection member 100 with catch member 200 and thereby constrain movement of use-engageable component 2 in the first direction A. Suitably, after sufficient rest, or after reducing the load of (e.g. removing weights from) user-engageable component 2, controller 500 can be used to disengage projection member 1001 from projection member 2001.

Advantageously, in preferred embodiments described herein wherein counterbalance 100 and user-engageable component 2 comprise locking devices 101, unlocking of locking devices 101 of user-engageable component 2 does not require actuation of second switch 520 of controller 500, whereas unlocking of locking devices 101 mounted to counterbalances 100 does require actuation of second switch 520 of controller 500. This arrangement is advantageous as it allows for unlocking and use of user-engageable component 2 while counterbalance 100 remains locked. This can be particularly advantageous as it allows for a user to exercise with user-engageable component 2 in the absence of connection with counterbalance 100.

Advantageously, configuration of solenoid 3001 of locking device 10 is such that the electromagnet of solenoid 3001 is activated in the unextended position, and inactivated in the extended position. In this embodiment of the invention, advantageously, during a power outage, movement of user-engageable component 2 and counterbalance 100 of the exercise apparatus is constrained in the first direction A.

However, it will be appreciated that in other embodiments of the device of the invention, the electromagnet of actuator 3001 is activated in the extend conformation.

Advantageously, locking device 101 is suitable for use with user-engageable component 2 of exercise apparatus 1. In addition to facilitating movement of the bar member of user-engageable component 2 in the first direction A and second direction A' which are substantially vertical directions, as hereinabove described, exercise apparatus 1 facilitates rotatable movement of the bar member of user-engageable component 2 relative to the longitudinal axes of vertical members 3, and horizontal movement of the bar member of user-engageable component 2.

When locking device 101 is mounted on mounting frame 20 of component 2 of exercise apparatus 1 as depicted in FIGS. 1, 2, and 4, projection member 1101 remains engageable with catches 2201 of catch member 2001 over the full range of movement of user-engageable component 2.

Advantageously, locking devices of the invention are suitable for use with a wide variety of exercise apparatus.

It will be readily understood by the skilled person that a locking device of the invention can be used to selectively constrain movement of a user-engageable component of an exercise apparatus in directions other than a substantially vertical direction, as described herein in relation to use of locking device 101 with exercise apparatus 1.

The skilled person will readily understand that a device of the invention can be used with any suitable exercise apparatus to constrain movement of a user-engageable component in any suitable first direction, wherein movement of a user-engageable component is substantially unconstrained in any suitable second direction.

By way of one non-limiting example, locking device 101 can be used with leg press apparatus, which often involve movement of a user-engageable component in an upwardly inclined plane.

As hereinabove described, it will be further readily understood that locking device 101 can be used with user-engageable components of exercise apparatus that are not bar members. As hereinbefore described, by way of one non-limiting example, locking device 101 can be used with leg press apparatus wherein the user-engageable component may comprise a frame comprising a user engageable platform.

As hereinbefore described, in an alternative embodiment of the locking device of the invention, the catches are movably mounted to vertical member 3 of exercise apparatus 1.

Suitably, in this alternative embodiment, movement of the catches with respect to the projection member is adapted to allow movement of the moveable component of the exercise apparatus in the second direction A' towards the upper end of vertical members 3, and to prevent movement of the user-engageable component of the exercise apparatus in the first direction A towards the lower end of vertical members 3.

The skilled person will readily appreciate that a range of mechanisms can be used to adapt the movement of movable catches in accordance with the abovementioned requirement.

By way of non-limiting example, movable catches may be comprised by catch members that are one or more cogs or belts, wherein the cogs or belts are mounted to an exercise apparatus so as to be rotatable about a rotation axis in one direction but not the opposite direction.

By way of another non-limiting example, a plurality of movable catches that are protrusions may be mounted by hinges to an exercise apparatus, wherein movement of the protrusions about the hinges allows a projection member to move past the catches in the second direction A', but constrains the projection members from moving past the catches in the first direction A.

In this specification, adjectives such as first and second, left and right, top and bottom, front and rear and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

In this specification, the terms 'comprises', 'comprising', 'includes', 'including', or similar terms are intended to mean a non-exclusive inclusion, such that a method, system or apparatus that comprises a list of elements does not include those elements solely, but may well include other elements not listed.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

The invention claimed is:

1. A load-adjusting device for adjusting a load movably mounted to a frame of an exercise apparatus, the device comprising:

a counterbalance;

a controller, wherein the counterbalance is configured to attach to the load in response to operation of the controller; and a holding member, wherein the counterbalance is connectable to the holding member;

wherein the counterbalance is substantially stationary relative to the frame of the exercise apparatus to which the device is mounted when connected to the holding member, and movable relative to the frame of the exercise apparatus when disconnected from the holding member.

2. The load-adjusting device of claim 1, wherein the device is configurable between an unassisted configuration wherein the counterbalance is not in operative connection with the load, and an assisted configuration wherein the counterbalance is operatively connected with the load.

3. The load-adjusting device of claim 2, wherein in the assisted configuration the load is reduced by the device, and in the unassisted configuration the load is substantially unaffected by the device.

4. The load-adjusting device of claim 1, wherein the device further comprises a pulley, and when the load and the counterbalance are operatively connected, the counterbalance applies a force to the load via the pulley.

5. The load-adjusting device of claim 4, wherein the counterbalance and the load are releasably connectable via a connecting member of the pulley, and wherein operative connection of the load with the counterbalance requires connection of the counterbalance with the load via the connecting member of the pulley.

6. The load-adjusting device of claim 1, wherein the device comprises one or more releasable locking devices for restraining movement of the load and/or the counterbalance relative to the frame of the exercise apparatus to which the load-adjusting device is mounted.

7. The load-adjusting device of claim 6, wherein the device comprises a locking device connected to the counterbalance and/or a locking device connected to the load.

8. The load-adjusting device of claim 1, wherein the counterbalance of the device comprises: a counterbalance mounting portion; and a counterbalance receiving portion.

9. The load-adjusting device of claim 8, wherein the counterbalance mounting portion is movably mounted to the frame of the exercise apparatus to which the device is mounted and/or rigidly engaged with a connecting member of a pulley of the load-adjusting device.

10. The load-adjusting device of claim 8, wherein the receiving portion of the counterbalance facilitates adjustment of the force exerted by the counterbalance on the load and/or is configured to receive one or more weights.

11. The load-adjusting device of claim 1, wherein the counterbalance of the device comprises a counterbalance connecting portion for connecting with the holding member.

12. The load-adjusting device of claim 1, wherein the counterbalance comprises a counterbalance connecting portion for connecting with the holding member.

13. The load-adjusting device of claim 12, wherein the counterbalance connecting portion facilitates engagement of the counterbalance with the holding member, the holding member including an electromagnet.

14. The load-adjusting device of claim 1, wherein operation of the controller signals one or more locking devices of the load-adjusting device to lock or unlock the locking devices.

15. The load-adjusting device of claim 1, operation of the controller signals the holding member to connect or disconnect the counterbalance from the holding member.

16. A method of adjusting a load movably mounted to an exercise apparatus, comprising:

operating a controller;

attaching a counterbalance to the load according to the operation of the controller;

and adjusting the load, wherein the counterbalance is connectable to a holding member, wherein the counterbalance is substantially stationary relative to a frame of the exercise apparatus to which the device is mounted when connected to the holding member, and movable relative to the frame of the exercise apparatus when disconnected from the holding member.

17. The method of claim 16, wherein connecting the counterbalance to the load includes the step of unlocking a locking device mounted to the counterbalance or disconnecting the counterbalance from the holding member.

* * * * *